United States Patent [19]

Baxter

[11] Patent Number: 4,635,564

[45] Date of Patent: Jan. 13, 1987

[54] FURNITURE CONSTRUCTION

[76] Inventor: Stanton E. Baxter, P.O. Box 8986, 3812 Anson La., Virginia Beach, Va. 23450

[21] Appl. No.: 778,007

[22] Filed: Sep. 20, 1985

[51] Int. Cl.[4] ..... A47B 3/00

[52] U.S. Cl. ..... 108/111; 108/153

[58] Field of Search ..... 108/111, 153; 211/186, 211/187

[56] References Cited

U.S. PATENT DOCUMENTS

| | | | |
|---|---|---|---|
| 2,560,957 | 7/1951 | Johnson | 211/186 X |
| 2,908,400 | 10/1959 | Richter | 108/111 X |
| 3,069,216 | 12/1962 | Vaeth | 108/111 X |
| 3,612,289 | 10/1971 | Zink | 108/111 |
| 4,022,327 | 5/1977 | Anderson | 211/186 X |
| 4,136,623 | 1/1979 | Dickson | 108/111 |
| 4,167,908 | 9/1979 | Jones et al. | 108/111 |

*Primary Examiner*—Kenneth J. Dorner
*Assistant Examiner*—José V. Chen
*Attorney, Agent, or Firm*—Wells & Wells

[57] ABSTRACT

A furniture construction such as bookcases, shelves and room dividers is assembled without fasteners from three basic interlocking notched elements. The three elements are planar, longitudinal horizontal and vertical support elements and shelf units. The horizontal support elements and a first shelf unit form the base and the vertical support elements are interconnected with the base and additional shelving units by the notches in each of the elements. The vertical supports on the ends have the notches in the leading edges and the vertical supports intermediate the ends have the notches in the following edges.

6 Claims, 6 Drawing Figures

FIG. 4
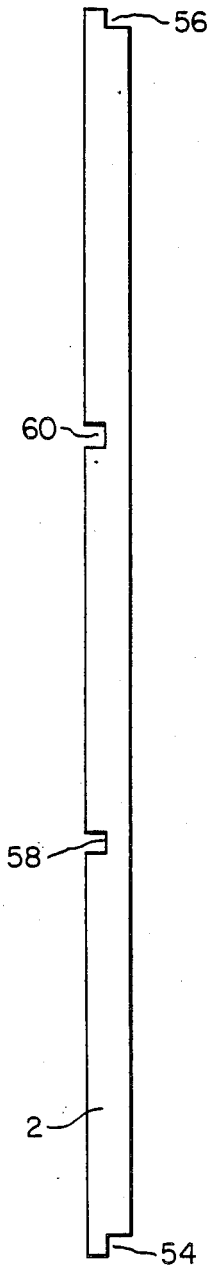
FIG. 5
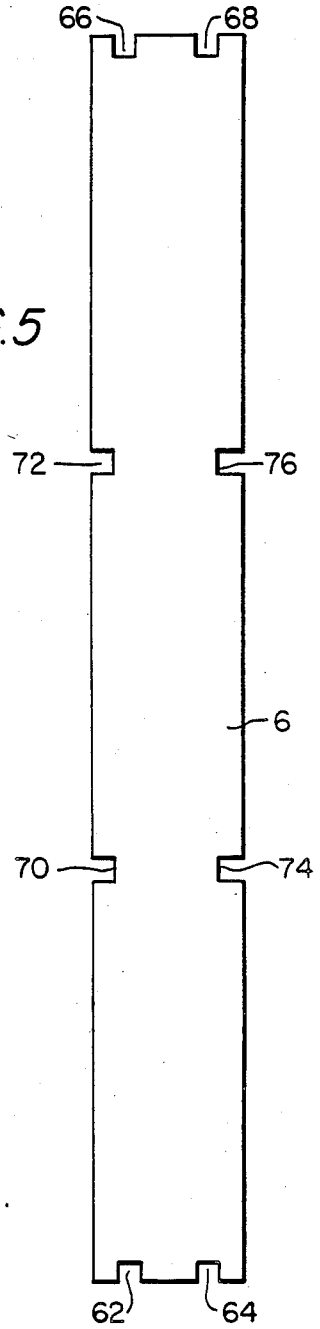
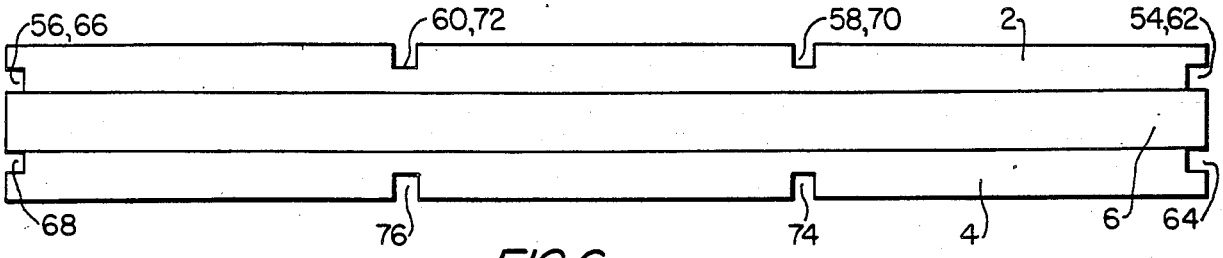
FIG. 6

FURNITURE CONSTRUCTION

BACKGROUND OF THE INVENTION

The field of the invention is horizontally supported planar surfaces and the present invention is particularly concerned with plural related horizontal surfaces having separable components.

The present invention relates to improvements in furniture constructions such as bookcases, shelves, and room dividers having substantially flat components which are easily assembled without the use of fasteners, such as screws, bolts, nails and cement.

U.S. Pat. No. 3,612,289 shows the state of the art of furniture constructions which do not require the use of fasteners and the disclosure of this patent is incorporated herein by reference.

Prior art furniture constructions which do not require the use of fasteners do not necessarily take advantage of the weight of the contents for increasing the stability of the furniture construction.

SUMMARY OF THE INVENTION

Having in mind the limitations of the prior art it is an object of the present invention to provide a furniture construction such as bookcases, shelves and room dividers having flat components which are held together without fasteners and increase in stability when loads such as books are applied thereto.

This object is achieved by the assembly of a furniture construction from three basic interlocking notched elements. In a preferred embodiment these three elements comprise horizontal square notched 2 by 4's, vertical square notched 2 by 4's and shelving having square notches on the outer edges and ends.

In an exemplary embodiment the furniture construction is an open shelf unit consisting of vertical 2 by 4's for support and stability and shelves of at least three-fourths inch finished board lumber thickness. It has two horizontal 2 by 4's on the bottom to support and distribute the weight over a larger surface area. The shelf unit has no glue, nails, screws, or dowels. It is held together entirely by interlocking cuts on the 2×4's and shelves. It is free-standing without attachment to wall, ceiling, or floor.

The unit height is normally slightly less than floor to ceiling height; however, it can be substantially below ceiling height if the unit is placed on a solid floor. The distance between the shelves is varied to accommodate different requirements of the objects to be placed on the shelves. The number of shelves is dependent upon the overall height and distance between shelves.

The depth of the unit is varied depending upon availability of materials (shelves) of sufficient quality and individual needs or requirements.

The unit length is limited only by the length of materials available or the size of the room in which it is placed with sufficient clearance to allow assembly. The unit can be made to a shorter length to meet the requirements of installation in a particular area. The required number of vertical 2 by 4's is determined by the length of the unit. Normally, the distance between them should not exceed 36 inches to ensure adequate support for the weight of the shelves and their loads and to reduce the possibility of shelves warping.

The vertical 2 by 4's have notches cut halfway into the 2 by 4 at desired shelf positions. The shelves have two notches on each end. These notches are spaced to allow the uncut portion of the 2 by 4's to fit into the notches. The shelves also have notches cut along the front and back edges spaced to accommodate the central vertical 2 by 4's.

The shelf and notches provide the fore and aft stability by locking in the end vertical 2 by 4's, thus preventing their motion to fall away from one another. The shelf front and back notches provide longitudinal stability by locking in the center 2 by 4's, thus preventing their motion from side to side.

BRIEF DESCRIPTION OF THE DRAWINGS

The invention is best explained by reference to the accompanying drawings, wherein:

FIG. 4 is a plan view of a horizontal 2 by 4 element of the present invention as used in FIG. 1;

FIG. 5 is a plan view of a shelf unit of the present invention as used in FIG. 1; and FIG. 6 is a bottom view of FIG. 1.

DESCRIPTION OF THE PREFERRED EMBODIMENTS

Figure 3:
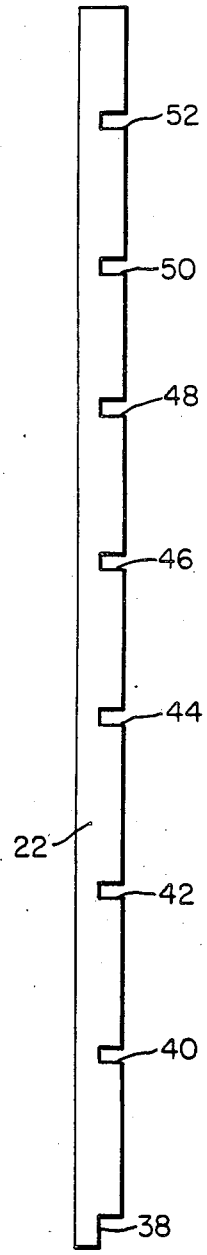
FIG. 3 is a plan view of a vertical 2 by 4 element of the present invention as used in FIG. 1.

The furniture construction of the present invention is made up of the elements shown in FIGS. 3 to 5 wherein FIG. 3 shows a vertical 2 by 4 element. FIG. 4 shows a horizontal 2 by 4 element and FIG. 5 shows a shelf unit.

Figure 1:
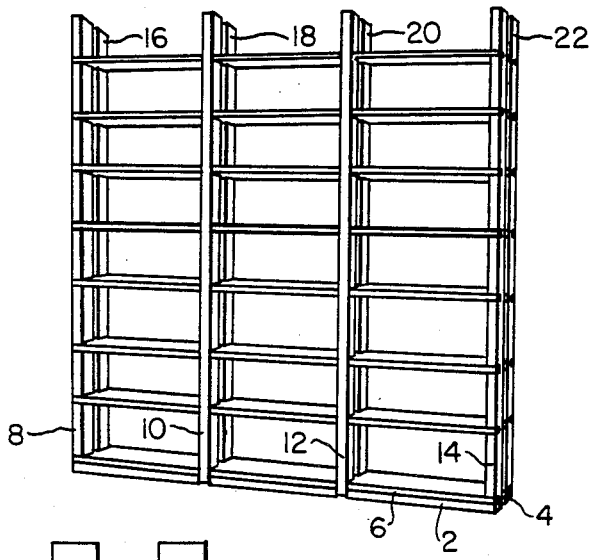
FIG. 1 is a perspective view of an embodiment of the present invention in the form of open shelving.
Figure 2:
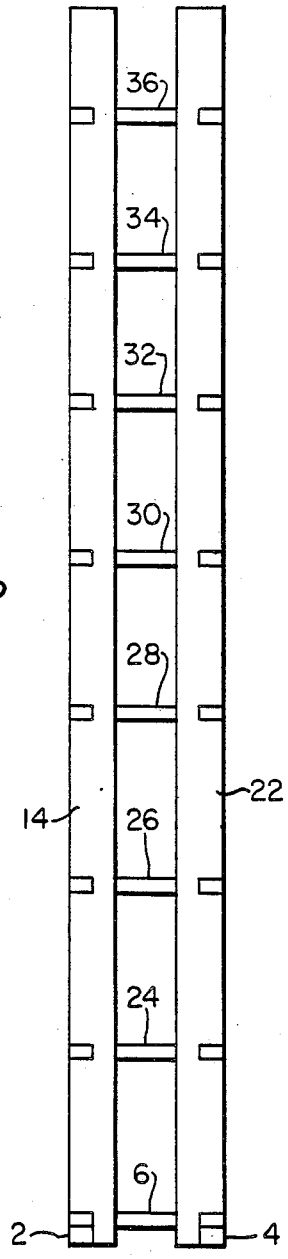
FIG. 2 is an end view of FIG. 1.

With particular reference to FIGS. 1 and 2, an open shelving construction has two horizontal 2 by 4's (2) and (4) on the base thereof covered by shelf unit (6).

Vertical 2 by 4's (8), (10), (12) and (14) in the front of the open shelving and vertical 2 by 4's (16), (18), (20) and (22) in the rear of the open shelving support shelf units (24), (26), (28), (30), (32), (34) and (36).

Each vertical 2 by 4, such as element (22) shown in FIGS. 1, 2, and 3, has an end notch (38) to engage notches in horizontal 2 by 4 (4) and shelf unit (6) and notches (40), (42), (44), (46), (48), (50) and (52) to engage notches in shelf units (24), (26), (28), (30), (32), (34), and (36).

The two horizontal 2 by 4's as illustrated by element (2) in FIG. 4 have two end notches (54) and (56) for engaging the end notches of vertical 2 by 4's (8) and (14) and intermediate notches (58) and (60) for engaging the end notches of vertical 2 by 4's (10) and (12).

Shelf unit (6) as shown in FIG. 5 has notches (62) and (64) at one end for engaging the end notches of vertical 2 by 4's (14) and (22) and end notches (66) and (68) for engaging the end notches of vertical 2 by 4's (8) and (16).

Notches (70) and (72) on the front edge of shelf unit (4) engage the end notches of vertical 2 by 4's (10) and (12) and notches (74) and (76) on the rear edge of shelf unit (6) engage the end notches of vertical 2 by 4's (18) and (20).

BEST MODE OF CARRYING OUT THE INVENTION

In order to assemble the open shelving of FIG. 1 the two vertical 2 by 4's (18) and (20) are placed against a vertical wall with their end notches on the floor. The two horizontal 2 by 4's (2) and (4) are placed on the floor at the bases of the vertical 2 by 4's. Shelf unit (6)

is placed on top of the two horizontal 2 by 4's and the end notches of vertical 2 by 4's are engaged with notches (74) and (76).

Shelf units (24), (26), (28), (30), (32), (34) and (36) are then fitted respectively into the next level of notches on vertical 2 by 4's (18) and (20).

Each of the vertical 2 by 4's (10) and (12) is fitted in turn so that their notches connect with shelf units (6), (24), (26), (28), (30), (32), (34) and (36).

Each of the vertical 2 by 4's (8), (16), (22) and (14) is fitted in turn so that their notches connect with shelf units (6), (24), (26), (28), (30), (32), (34) and (36).

Books are then placed in the open shelving and the weight of the books further secures the notches of each shelf unit in the notches of the horizontal and vertical 2 by 4's.

What I claim is:

1. A furniture construction comprising:

(a) a plurality of horizontal, planar, longitudinal support elements each of which has a front edge, a rear edge, a top side, a bottom side, a first end, a second end, a first notch formed in a corner between said first end and rear edge, a second notch formed in a corner between said second end and rear edge and a plurality of notches extending from said rear edge to said front edge and open to said front edge;

(b) a plurality of shelf units having a first shelf unit resting on said side of said support elements and having a front edge, a rear edge, a first end and a second end, said front edge having a plurality of notches extending from said rear edge to said front edge and open to said front edge, said rear edge having a plurality of notches extending from said front edge to said rear edge and open to said rear edge, said first end having a plurality of notches extending from said second end to said first end and open to said first end, and said second end having a plurality of notches extending from said first end to said second end and open to said second end; and (c) a plurality of vertical, planar, longitudinal support elements each of which has a front edge, a rear edge, a bottom end and a top end, a notch at said bottom end of each of said vertical support elements formed in a corner between said bottom end and said rear edge and a plurality of notches intermediate said bottom end and said top end extending from said front edge to said rear edge and open to said rear edge, four of said vertical support elements having said notches mating with said end notches in said horizontal support elements and said first shelf unit, and a plurality of said vertical support elements having said notches in said rear edges mating with said notches in said front and rear edges in said plurality of shelf units having the same configuration as said first shelf unit.

2. The furniture construction of claim 1, wherein said notches are square.

3. The furniture construction of claim 2, wherein said vertical and horizontal support elements are two inches by four inches finished lumber boards.

4. The furniture construction of claim 3, wherein said shelf units are three quarter inch finished lumber boards.

5. The furniture construction of claim 4, having two of said horizontal support elements, four of said vertical support elements with notches in their forward edges and four of said vertical support elements with notches in their rear edges.

6. The furniture construction of claim 5, having seven shelf units in addition to said first shelf unit.

* * * * *